United States Patent [19]

Kashiwagi et al.

[11] Patent Number: 4,659,885

[45] Date of Patent: Apr. 21, 1987

[54] VACUUM INTERRUPTER

[75] Inventors: Yoshiyuki Kashiwagi; Yasushi Noda, both of Tokyo; Kaoru Kitakizaki, Higashimine, all of Japan

[73] Assignee: Kabushiki Kaisha Meidensha, Tokyo, Japan

[21] Appl. No.: 591,481

[22] Filed: Mar. 20, 1984

[30] Foreign Application Priority Data

| | | | |
|---|---|---|---|
| Mar. 22, 1983 | [JP] | Japan | 58-47561 |
| Jul. 21, 1983 | [JP] | Japan | 58-134078 |
| Jul. 30, 1983 | [JP] | Japan | 58-139872 |
| Sep. 22, 1983 | [JP] | Japan | 58-175655 |
| Sep. 27, 1983 | [JP] | Japan | 58-178696 |
| Sep. 27, 1983 | [JP] | Japan | 58-178698 |
| Sep. 27, 1983 | [JP] | Japan | 58-178699 |

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,246,979 | 4/1966 | Lafferty et al. | 200/144 B |
| 3,462,572 | 8/1969 | Sofianek | 200/144 B |
| 3,811,939 | 5/1974 | Hassler et al. | 200/144 B |
| 4,347,413 | 8/1982 | Watanabe et al. | 200/144 B |
| 4,471,184 | 9/1984 | Sano et al. | 200/144 B |

FOREIGN PATENT DOCUMENTS

| | | | |
|---|---|---|---|
| 2024258 | 1/1980 | United Kingdom | 200/144 B |

*Primary Examiner*—Robert S. Macon

*Attorney, Agent, or Firm*—Schwartz, Jeffery, Schwaab, Mack, Blumenthal & Evans

[57] ABSTRACT

A vacuum interrupter of improved large current interrupting capability and dielectric strength has a pair of separable electrodes (5,6) a vacuum envelope (4) electrically insulating and enclosing the pair therewithin, a contact-making portion (14) of material of 20 to 60% IACS electrical conductivity being a part of one electrode (6) of the pair, a magnetically arc-rotating portion (13) of material of 2 to 30% IACS electrical conductivity secured to the contact-making portion (14) so as to be apart from the other electrode (5) when the electrodes (5,6) are in engagement, and means, which include a plurality of slots extending radially and circumferentially of the magnetically arc-rotating portion (13) and being apart from each other, for magnetically rotating the arc established between the electrodes (5,6) on an arcing surface of the electrode (6).

19 Claims, 41 Drawing Figures

10 μm

10 μm

10 μm

10 μm

VACUUM INTERRUPTER

BACKGROUND OF THE INVENTION

1. Field of the Invention

The present invention relates to a vacuum interrupter, more particularly to a vacuum interrupter including an electrode of a magnetically arc-rotating type (hereinafter, the interrupter is referred to as a vacuum interrupter of the magnetically arc-rotating type).

2. Description of the Prior Art

Recently, it has been required to provide a vacuum interrupter of the same size or less as a conventional interrupter and which enhances large current interrupting capability and dielectric strength to cope with increasing of an electric power supply network.

A vacuum interrupter of the magnetically arc-rotating type includes a vacuum envelope and a pair of separable electrodes within the envelope. At least one electrode of the pair is disc-shaped and has a plurality of slots for arc rotation therein, a lead rod which is secured by brazing to the central portion of the backsurface of the electrode and electrically connected to an electric power circuit at an outside of the envelope, and a contact-making portion provided at the central portion of the surface of the electrode. The one electrode outwardly radially and circumferentially drives an arc which is established between the electrodes, by an interaction between the arc and a magnetic field which is produced by arc current flowing radially and outwardly from the contact-making portion to the one electrode during a separation of the electrodes, and by virtue of the slots. Consequently, the one electrode prevents an excessive local heating and melting of the electrodes, thus enhancing the large current interrupting capability and dielectric strength of the vacuum interrupter.

The structure of the electrode and the characteristics of electrode material contribute to a large extent to increasing both the large current interrupting capability and the dielectric strength of the interrupter.

Generally, the electrode itself is required to consistently satisfy the following requirements:

(i) increasing large-current interrupting capability,
(ii) increasing dielectric strength,
(iii) increasing small leading-current interrupting capability and small lagging-current interrupting capability,
(iv) reducing the amount of current chopping,
(v) posessing low electrical resistance,
(vi) possessing excellent anti-welding capability, and
(vii) possessing excellent anti-erosional capability.

However, an electrode consistently satisfying all the above requirements, in the present state of the art, has not been provided.

For example, as an electrode of a conventional vacuum interrupter, there is known an electrode of which a magnetically arc-rotating portion is made of copper and of which a contact-making portion is made of Cu-Bi alloy such as Cu-0.5Bi alloy that consists of copper and 0.5% bismuth by weight added as shown in U.S. Pat. No. 3,246,979; Another example is known of an electrode of which a magnetically arc-rotating portion is made of copper and of which a contact-making portion is made of Cu-W alloy such as 20Cu-80W alloy that consists of 20% copper by weight and 80% tungsten by weight as shown in U.S. Pat. No. 3,811,939.

According to the above electrodes, small mechanical strength, i.e., about 196.1 MPa (20 kgf/mm$^2$) in tensile strength, of copper causes a magnetically arc-rotating portion to be shaped thick and heavy so that the magnetically arc-rotating portion might prevent a deformation thereof due to a mechanical impact and an electromagnetic force from large current which is applied to the pair of electrodes when a vacuum interrupter is closed and opened. However, it increases a size of the vacuum interrupter.

Additionally, according to the magnetically arc-rotating portion which is thickened and heavy, portions defined by a plurality of slots (hereinafter, referred to as fingers) cannot be lengthened due to the mechanical performance in order to enhance a magnetically arc-rotating force so that the vacuum interrupter difficulty enhances the large-current interrupting capability.

Additionally, the fingers may be eroded by excessive melting and evaporation thereof due to a large current arc because copper and Cu-0.5Bi alloy are soft, and have a vapor pressure considerably higher than that of tungsten and a melting point considerably lower than that of tungsten.

SUMMARY OF THE INVENTION

An object of the present invention is to provide a vacuum interrupter of a magnetically arc-rotating type which possesses high large-current interrupting capability and dielectric strength.

Another object of the present invention is to provide a vacuum interrupter of a magnetically arc-rotating type which possesses high resistance against mechanical impact and electromagnetic forces from a large-current arc therefore, and has a long period durability.

In attaining these objects a vacuum interrupter includes a pair of separable electrodes, a vacuum envelope which is generally electrically insulating, enclosing the pair of electrodes therewithin, a contact-making portion of 20 to 60% IACS electrical conductivity, being one part of at least one electrode of the pair and being placed into and out of engagement with the other electrode, a magnetically arc-rotating portion of 2 to 30% IACS electrical conductivity generally disc-shaped, being the other part of the one electrode, including an arcing surface adapted for a foot of arc to move on and being secured to the contact-making portion so as to be spaced from the other electrode when the pair of electrodes are in engagement, and means, which include a plurality of slots spaced from each other and extending radially and circumferentially of the magnetically arc-rotating portion, for magnetically rotating the arc on the arcing surface.

BRIEF DESCRIPTION OF THE DRAWINGS

FIGS. 5A to 5D all are photographs by an X-ray microanalyzer of a structure of Example $A_1$ of a complex metal constituting a magnetically arc-rotating portion, of which:

FIG. 5A is a secondary electron image photograph of the structure.

FIG. 5B is a characteristic X-ray image photograph of iron.

FIG. 5C is a characteristic X-ray image photograph of chromium.

FIG. 5D is a characteristic X-ray image photograph of infiltrant copper.

FIGS. 6A to 6D all are photographs by the X-ray microanalyzer of a structure of Example $A_2$ of a complex metal constituting an arc-rotating portion, of which:

FIG. 6A is a secondary electron image photograph of the structure.

FIG. 6B is a characteristic X-ray image photograph of iron.

FIG. 6C is a characteristic X-ray image photograph of chromium.

FIG. 6D is a characteristic X-ray image photograph of infiltrant copper.

FIGS. 7A to 7D all are photographs by the X-ray microanalyzer of a structure of Example $A_3$ of a complex metal constituting the arc-rotating portion, of which:

FIG. 7A is a secondary electron image photograph of the structure.

FIG. 7B is a characteristic X-ray image photograph of iron.

FIG. 7C is a characteristic X-ray image photograph of chromium.

FIG. 7D is a characteristic X-ray image photograph of infiltrant copper.

FIGS. 8A to 8D all are photographs by the X-ray microanalyzer of a structure of of Example $C_1$ of a complex metal constituting a contact-making portion, of which:

FIG. 8A is a secondary electron image photograph of the structure.

FIG. 8B is a characteristic X-ray image photograph of molybdenum.

FIG. 8C is a characteristic X-ray image photograph of chromium.

FIG. 8D is a characteristic X-ray image photograph of infiltrant copper.

FIGS. 9A to 9D all are photographs by the X-ray microanalyzer of a structure of Example $C_2$ of a complex metal constituting the contact-making portion, of which:

FIG. 9A is a secondary electron image photograph of the structure.

FIG. 9B is a characteristic X-ray image photograph of molybdenum.

FIG. 9C is a characteristic X-ray image photograph of chromium.

FIG. 9D is a characteristic X-ray image photograph of infiltrant copper.

FIGS. 10A to 10D all are photographs by the X-ray microanalyzer of a structure of Example $C_3$ of a complex metal constituting the contact-making portion, of which:

FIG. 10A is a secondary electron image photograph of the structure.

FIG. 10B is a characteristic X-ray image photograph of molybdenum.

FIG. 10C is a characteristic X-ray image photograph of chromium.

FIG. 10D is a characteristic X-ray image photograph of infiltrant copper.

FIGS. 11A to 11D all are photographs by the X-ray microanalyzer of a structure of Example $A_4$ of a complex metal constituting the arc-rotating portion, of which:

FIG. 11A is a secondary electron image photograph of the structure.

FIG. 11B is a characteristic X-ray image photograph of iron.

FIG. 11C is a characteristic X-ray image photograph of chromium.

FIG. 11D is a characteristic X-ray image photograph of infiltrant copper.

FIGS. 12A to 12D all are photographs by the X-ray microanalyzer of a structure of Example $A_7$ of a complex metal constituting the arc-rotating portion, of which:

FIG. 12A is a secondary electron image photograph of the structure.

FIG. 12B is a characteristic X-ray image photograph of iron.

FIG. 12C is a characteristic X-ray image photograph of chromium.

FIG. 12D is a characteristic X-ray image photograph of infiltrant copper.

FIGS. 13A to 13E all are photographs by the X-ray microanalyzer of a structure of Example $A_{10}$ of a complex metal constituting the arc-rotating portion, of which:

FIG. 13A is a secondary electron image photograph of the structure.

FIG. 13B is a characteristic X-ray image photograph of iron.

FIG. 13C is a characteristic X-ray image photograph of chromium.

FIG. 13D is a characteristic X-ray image photograph of nickel.

FIG. 13E is a characteristic X-ray image photograph of infiltrant copper.

DESCRIPTION OF THE PREFERRED EMBODIMENT

Figure 1:
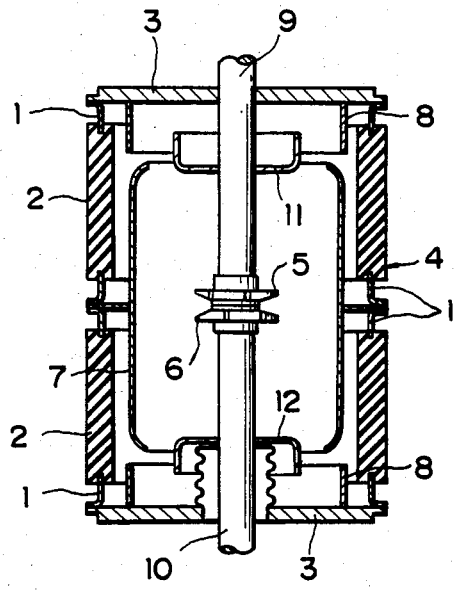
FIG. 1 is a sectional view through a vacuum interrupter of a magnetically arc-rotating type according to the present invention.

Referring to FIGS. 1 to 13 of the accompanying drawings and photographs, preferred embodiments of the present invention will be described in detail. As shown in FIG. 1, a vacuum interrupter of a 1st embodiment of the present invention includes a vacuum envelope 4, the inside of which is evacuated to, e.g., a pressure of no more than 13.4 mPa ($10^{-4}$ Torr) and a pair of stationary and movable electrodes 5 and 6 located within the vacuum envelope 4. Both the electrodes 5 and 6 belong to a magnetically arc-rotating type. The vacuum envelope 4 comprises, in the main, two the same-shaped insulating cylinders 2 of glass or alumina ceramics which are serially and hermetically associated by welding or brazing to each other by means of sealing metallic rings 1 of Fe-Ni-Co alloy or Fe-Ni alloy at the adjacent ends of the insulating cylinders 2, and a pair of metallic end plates 3 of austinitic stainless steel hermetically associated by welding or brazing to both the remote ends of the insulating cylinders 2 by means of sealing metallic rings 1. A metallic arc shield 7 of a cylindrical form which surrounds the electrodes 5 and 6 is supported on and hermetically joined by welding or brazing to the sealing metallic rings 1 at the adjacent ends of the insulating cylinders 2. Further, metallic edge-shields 8 which moderate an electric field concentration at edges of the sealing metallic rings 1 at the remote ends of the insulating cylinders 2 are joined by welding or brazing to the pair of metallic end plates 3. An axial shield 11 and a bellows shield 12 are provided on respective stationary and movable lead rods 9 and 10 which are secured by brazing to the respective stationary and movable contact-electrodes 5 and 6. The arc shield 7, edge shield 8, axial shield 11 and bellows shield 12 all are made of austinitic stainless steel.

Figure 2:
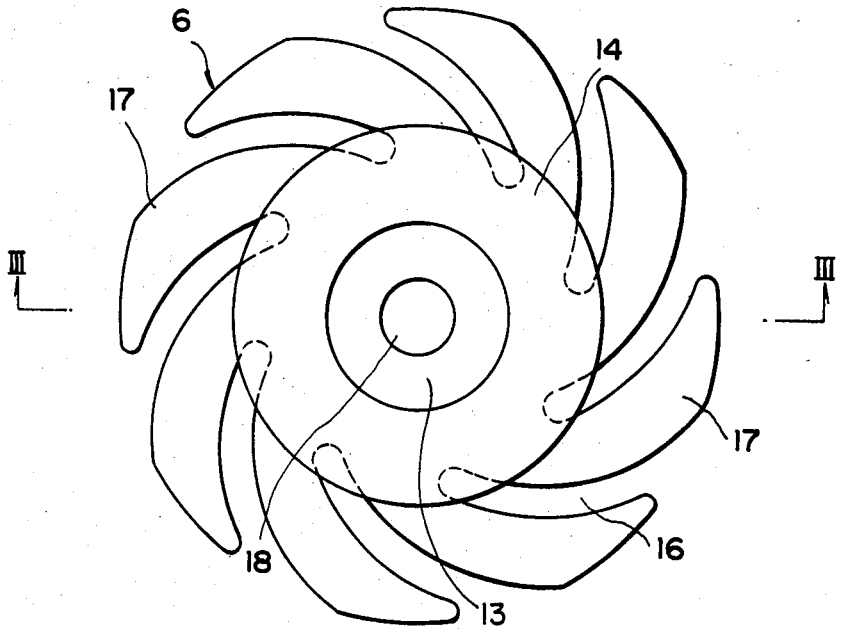
FIG. 2 is a plan view of a movable electrode of FIG. 1.
Figure 3:
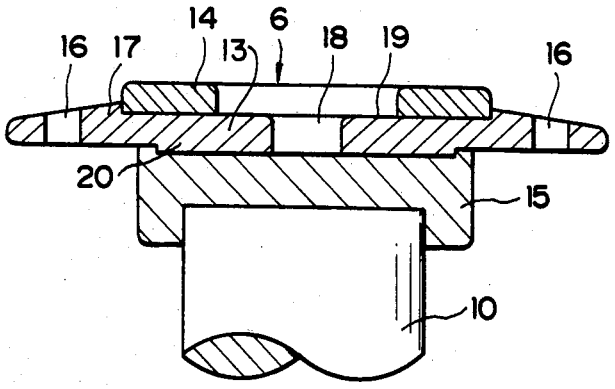
FIG. 3 is a sectional view taken along III—III line of FIG. 2.

The electrodes 5 and 6 have the same construction and the movable electrode 6 will be described hereinafter. As shown in FIGS. 2 and 3, the movable electrode 6 consists of a magnetically arc-rotating portion 13 and an annular contact-making portion 14 which is secured by brazing to the surface of the magnetically arc-rotating portion 13 around the center thereof.

The magnetically arc-rotating portion 13 is made of material of 10 to 20%, preferably 10 to 15% IACS (an abbreviation of International Annealed Copper Standard) electrical conductivity. For example, the latter material may be a complex metal of about 294 MPa (30 kgf/mm$^2$) tensile strength consisting of 50% copper by weight and 50% austinitic stainless steel by weight, e.g., SUS304 or SUS316 (at JIS, hereinafter, at the same), or a complex metal of about 294 MPa (30 kgf/mm$^2$) tensile strength consisting of 50% copper by weight, 25% chromium by weight and 25% by iron by weight. A process for producing the complex metal will be hereinafter described.

The magnetically arc-rotating portion 13, which is generally disc-shaped, is much thinner than a magnetically arc-rotating portion of a conventional type. As shown in FIG. 2, the magnetically arc-rotating portion 13 includes a plurality (in FIG. 2, eight) of spiral slots 16 and a plurality (in FIG. 2, eight) of spiral fingers 17 defined by the slots 16. The surfaces of the fingers 17, which are formed slightly slant from the center of the magnetically arc-rotating portion 13 to the periphery thereof, serve as an arcing surface. A circular recess 18 is provided at the center of the magnetically arc-rotating portion 13. The circular recess 19, a diameter of which is larger than that of the movable lead rod 10, is provided at the center of the surface of the magnetically arc-rotating portion 13. The contact-making portion 14, the outer-diameter of which is equal to that of the circular recess 19, is fitted into the circular recess 19 and brazed to the magnetically arc-rotating portion 13. The contact-making portion 14 is projecting from the surface of the magnetically arc-rotating portion 13. A boss 20 is provided at the center of the backsurface of the magnetically arc-rotating portion 13.

The contact-making portion 14 is made of material of 20 to 60% IACS electrical conductivity, e.g., a complex metal consisting of 20 to 70% copper by weight, 5 to 70 chromium by weight and 5 to 70% molybdenum by weight. A process for producing the complex metal will be hereinafter described. In this embodiment, the contact-making portion 14 exhibits substantially the same electrical contact resistance due to its thin thickness, as a contact-making portion of Cu-0.5Bi alloy.

A current conductor 15 which, on the surface thereof, is brazed to the boss 20, is made of material of electrical conductivity much higher than that of a material for the magnetically arc-rotating portion 13, e.g., of copper or copper alloy.

The current conductor 15 has the shape of a thickened disc having a diameter larger than that of the movable lead rod 10 but slightly smaller than the outer-diameter of the contact-making portion 14. The backsurface of the current conductor 15 is brazed to the inner end of the movable lead rod 10. Under the presence of the current conductor 15, most of a current led from the movable lead rod 10 flows not in a radial direction of the magnetically arc-rotating portion 13 of low electrical conductivity but in that of the current conductor 15 and an axial direction of the magnetically arc-rotating portion 13 to the contact-making portion 14. Consequently, an amount of Joule heat in the magnetically arc-rotating portion 13 is much reduced.

A performance comparison test was carried out between a vacuum interrupter of a magnetically arc-rotating type according to the 1st embodiment of the present invention, and a conventional vacuum interrupter of a magnetically arc-rotating type. The former interrupter includes a pair of electrodes each consisting of a contact-making portion which is made of a complex metal consisting of 50% copper by weight, 10% chromium by weight and 40% molybdenum by weight and a magnetically arc-rotating portion which is made of a complex metal consisting of 50% copper by weight and 50% SUS304 by weight. The latter interrupter includes a pair of electrodes each consisting of a contact-making portion which is made of Cu-0.5Bi alloy, and a magnetically arc-rotating portion which is made of copper.

Results of the performance comparison test will be described as follows:

In the specification, amounts of voltage and current are represented in a rms value if not specified.

(1) Large current interrupting capability

The large-current interrupting capability of the vacuum interrupter of 1st embodiment of the present invention was improved at least 10% of that of the conventional vacuum interrupter and more stable than that thereof.

(2) Dielectric strength

In accordance with JEC-181 test method, withstand voltages were measured of the vacuum interrupter of the 1st embodiment of the present invention and the conventional vacuum interrupter, with a 3.0 mm gap between the contact-making portions relative to the present invention but with a 10 mm gap between the contact-making portions relative to the conventional vacuum interrupter. In this case, both the vacuum interrupters exhibited the same withstand voltage. Thus, the vacuum interrupter of the present invention possesses 3 times the dielectric strength, as that of the conventional vacuum interrupter.

There were also measured before and after interrupting large-current, e.g., current of rated 84 kV and 25 kA withstand voltages for the 1st embodiment of the present invention, and of the conventional vacuum interrupter.

Figure 4:
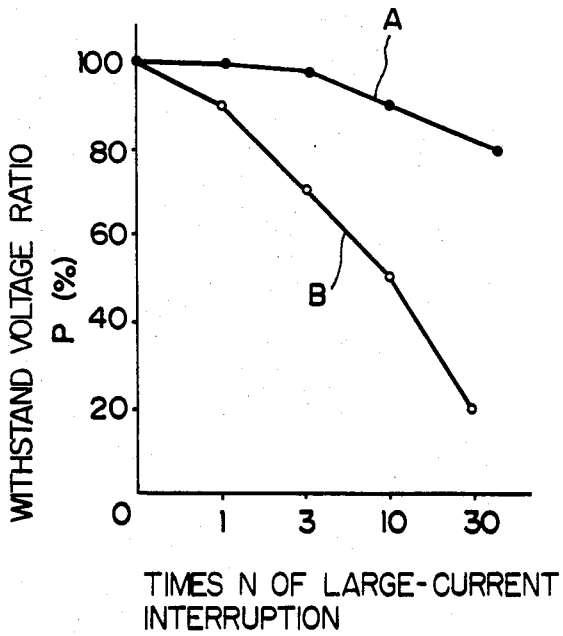
FIG. 4 is a diagram illustrative of a relation between times N of a large-current interruption and a ratio P of an amount of withstand voltage of a vacuum interrupter after the large-current interruption to an amount of withstand voltage of the vacuum interrupter before the large-current interruption.

FIG. 4 shows the results of the measurement. In FIG. 4, the abscissa represents the number of times N (times) of interruption of large-current of rated 84 kV and 25 kA, while the ordinate represents a ratio P (%) of withstand voltage after large-current interruption to withstand voltage therebefore. Moreover, in FIG. 4, the line A indicates a relationship between the number of times N of the interruption and the ratio P relative to the vacuum interrupter of the 1st embodiment of the present invention, while the line B indicates a relationship between the number of times N of the interruption and the ratio P relative to the vacuum conventional interrupter.

As apparent from FIG. 4, the dielectric strength after large-current interruption of the vacuum interrupter of the 1st embodiment of the present invention is much higher than that of the conventional vacuum interrupter.

(3) Anti-welding capability

The anti-welding capability of the electrodes of the 1st embodiment of the present invention amounted to 80% of the anti-welding capability of those of the conventional vacuum interrupter. However, such decrease is not actually significant. If necessary, a disengaging force applied to the electrodes may be slightly enhanced.

(4) Lagging small current interrupting capability

A current chopping value of the vacuum interrupter of the 1st embodiment of the present invention amounted to 40% of that of the conventional vacuum interrupter, so that a chopping surge is almost insignificant. This value was maintained even after engaging and disengaging the electrodes for more than 100 times for interrupting lagging small current.

(5) Leading small current interrupting capability

The vacuum interrupter of the 1st embodiment of the present invention interrupted 2 times a charging current of the conventional vacuum interrupter connected to a condenser or unload line.

Performances of the vacuum interrupter of the 1st embodiment of the present invention are higher than those of the conventional vacuum interrupter in the aspects of large-current interrupting capability, dielectric strength, lagging small current interrupting capability and leading small current interrupting capability. In particular, the ratio of the dielectric strength after large-current interruption to that therebefore relative to the vacuum interrupter of the 1st embodiment of the present invention is much higher than that relative to the conventional vacuum interrupter.

Other embodiments of the present invention will be described hereinafter in which changes were made to each of the materials for the magnetically arc-rotating portions 13 and contact-making portions 14 of the pair of stationary and movable electrodes 5 and 6 as shown in FIG. 1.

FIGS. 5A to 5D, FIGS. 6A to 6D and FIGS. 7A to 7D show structures of the complex metals constituting magnetically arc-rotating portions 13 according to the 2nd to 10th embodiments of the present invention.

According to the 2nd to 10th embodiments of the present invention, a magnetically arc-rotating portion 13 is made of material of 5 to 30% IACS electrical conductivity, at least 294 MPa (30 kgf/mm$^2$) tensile strength and 100 to 170 Hv hardness (under a load of 9.81N (1 kgf), hereinafter under the same), e.g., a complex metal consisting of 20 to 70% copper by weight, 5 to 40% chromium by weight and 5 to 40% iron by weight. A process for producing the complex metal may be generally classified into two categories. A process of one category comprises a step of diffusion-bonding a powder mixture consisting of chromium powder and iron powder into a porous matrix and a step of infiltrating the porous matix with molten copper (hereinafter, referred to as an infiltration process). A process of the other category comprises a step of press-shaping a powder mixture consisting of copper powder, chromium powder and iron powder into a green compact and a step of sintering the green compact below the melting point of copper (about 1083° C.) or at at least the melting point of copper but below the melting point of iron (about 1537° C.) (hereinafter, referred to as a sintering process). The infiltration and sintering processes will be described hereinafter. Each metal powder was of minus 100 mesh.

The first infiltration process

Initially, a predetermined amount (e.g., an amount of one final electrode plus a machining margin) of chromium powder and iron powder which are respectively prepared 5 to 40% by weight and 5 to 40% by weight but in total 30 to 80% by weight at a final ratio, are mechanically and uniformly mixed.

Secondly, the resultant powder mixture is placed in a vessel of a circular section made of material, e.g., alumina ceramics, which interacts with none of chromium, iron and copper. A copper bulk is placed on the powder mixture.

Thirdly, the powder mixture and the copper bulk are heat held in a nonoxidizing atmosphere, e.g., a vacuum pressure of at highest 6.67 mPa ($5\times10^{-5}$ Torr) at 1000° C. for 10 min (hereinafter, referred to as a chromium-iron diffusion step), thus resulting in a porous matrix of chromium and iron. Then, the resultant porous matrix and the copper bulk are heat held under the same vacuum at 1100° C. for 10 min, which leads to infiltrating the porous matrix with molten copper (hereinafter, referred to as a copper infiltrating step). After cooling, a desired complex metal for the arc-diffusing portion is produced.

The second infiltration process

Initially, chromium powder and iron powder are mechanically and uniformly mixed in the same manner as in the first infiltration process.

Secondly, the resultant powder mixture is placed in the same vessel as that in the first infiltration process. The powder mixture is heat held in a nonoxidizing atmosphere, e.g., a vacuum pressure of at highest 6.67 mPa ($5\times10^{-5}$ Torr), or hydrogen, nitrogen or argon gas at a temperature below the melting point of iron, e.g., within 600° to 1000° C. for a fixed period of time, e.g., within 5 to 60 min, thus resulting in a porous matrix consisting of chromium and iron.

Thirdly, in the same nonoxidizing atmosphere, e.g., a vacuum pressure of at highest 6.67 mPa ($5\times10^{-5}$ Torr), as that of the chromium-iron diffusion step, or other nonoxidizing atmosphere, a copper bulk is placed on the porous matrix, then the porous matrix and the copper bulk are heat held at a temperature of at least the melting point of copper but below the melting point of the porous matrix for a fixed period of time, e.g., within about 5 to 20 min at a temperature of at least the melting point of copper but below the melting point of the porous matrix for a period of about 5 to 20 min, which leads to infiltration of the porous matrix with molten copper. After cooling, a desired complex metal resulted for the magnetically arc-rotating portion 13.

In the second infiltration process, the copper bulk is not placed in the vessel in the chromium-iron diffusion step, so that the powder mixture of chromium powder and iron powder can be heat held to the porous matrix at a temperature of at least the melting point (1083° C.) of copper but below the melting point (1537° C.) of iron.

As an alternative in the second infiltration process, the chromium-iron diffusion step may be performed in various nonoxidizing atmospheres, e.g., hydrogen, nitrogen or argon gas, and the copper infiltration step may be performed under vacuum, degassing the complex metal for the magnetically arc-rotating portion 13.

In both the infiltration processes, vacuum is preferably selected as a nonoxidizing atmosphere, but not other nonoxidizing atmosphere, because degassing of the complex metal for the magnetically arc-rotating portion 13 can be concurrently performed during heat holding. However, even if a deoxidizing gas or an inert gas is used as a nonoxidizing atmosphere, the resultant is satisfactory for producing the complex metal for the magnetically arc-rotating portion 13.

In addition, a heat holding temperature and period of time for the chromium-iron diffusion step is determined on a basis of taking into account conditions of the vacuum furnace or other gas furnace, the shape and size of a porous matrix and workability so that desired properties as those of a complex metal for the magnetically arc-rotating portion 13 will be produced. For example, a heating temperature of 600° C. determines a heat holding period of 60 min or a heating temperature of 100° C. determines a heat holding period of 5 min.

The particle size of chromium particles and iron particles may be minus 60 mesh, i.e., no more than 250 μm. However, the lower an upper limit of the particle size, generally the more difficult to uniformly distribute each metal particle. Further, it is more complicated to handle the metal particles and they, when used, necessitate a pretreatment because they are more liable to be oxidized.

On the other hand, if the particle size of each metal article exceeds 60 mesh, it is necessary to make the heat holding temperature higher or to make the heat holding period of time longer with a diffusion distance of each metal particle increasing, which leads to lower productivity of the chromium-iron diffusion step. Consequently, the upper limit of the particle size of each metal particle is determined in view of various conditions.

According to both infiltration processes, it is because the particles of chromium and iron can be more uniformly distributed to cause better diffusion bonding thereof, thus resulting in a complex metal for the the magnetically arc-rotating portion possessing better properties, that the particle size of each metal particle is determined to be minus 100 mesh. If chromium particles and iron particles are badly distributed, then drawbacks of both metals will not be offset by each other and advantages thereof will not be developed. In particular, the more the particle size of each metal particle exceeds 60 mesh, the larger in the proportion of copper in the surface region of a magnetically arc-rotating portion, which contributes to lowering of the dielectric strength of the electrode. Similarly chromium particles, iron particles and chromium-rion alloy particles which have large granulations are more likely to appear in the surface region of the magnetically arc-rotating portion, so that drawbacks of respective chromium, iron and copper are more apparent.

The sintering process

Initially, chromium powder, iron powder and copper powder which are prepared in the same manner as in the first infiltration process are mechanically and uniformly mixed.

Secondly, the resultant powder mixture is placed in a preset vessel and press-shaped into a green compact under a preset pressure, e.g., of 196.1 to 490.4 MPa (2,000 to 5,000 kgf/cm$^2$).

Thirdly, the resultant green compact which is taken out of the vessel is heat held in a nonoxidizing atmosphere, e.g., a vacuum pressure of at highest 6.67 mPa ($5\times10^{-5}$ Torr), or hydrogen, nitrogen or argon gas at a temperature below the melting point of copper, e.g., at 1000° C., or at a temperature of at least the melting point of copper but below the melting point of iron, e.g., at 1100° C. for a preset period of time, e.g., within 5 to 60 min, thus being sintered into the complex metal of the magnetically arc-rotating portion.

In the sintering process, conditions of the nonoxidizing atmosphere and the particle size of each metal particle are the same as those in both the infiltration processes, and conditions of the heat holding temperature and the heat holding period of time required for sintering the green compact are the same as those for producing the porous matrix from the powder mixture of metal powders in the infiltration processes.

Referred to FIGS. 5A to 5D, FIGS. 6A to 6D and FIGS. 7A to 7D which are photographs by the X-ray microanalyzer, structures of the complex metals for the magnetically arc-rotating portion 13 which are produced according to the first infiltration process above, will be described hereinafter.

Example $A_1$ of a complex metal for the magnetically arc-rotating portion possesses a composition consisting of 50% copper by weight, 10% chromium by weight and 40% iron by weight.

Figure 5A:
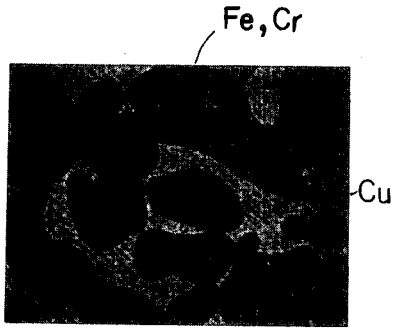
Figure 5B:
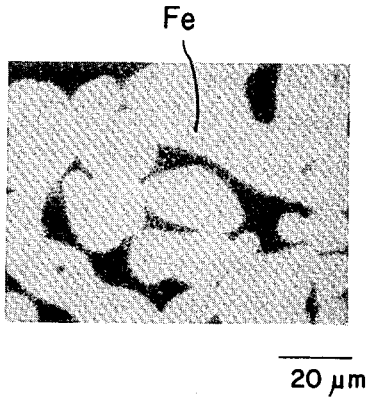
Figure 5C:
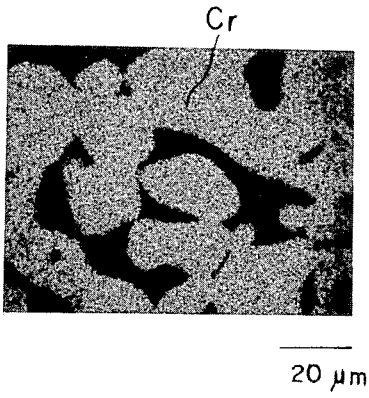
Figure 5D:
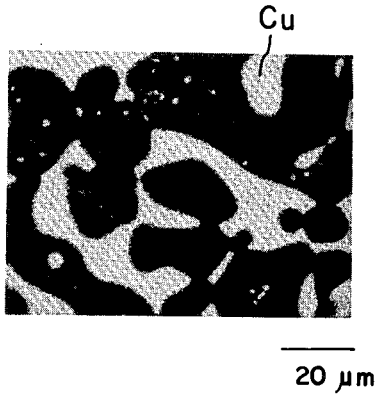
Figure 6A:
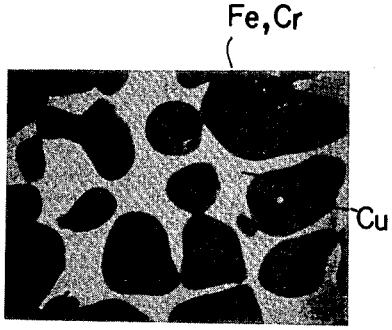
Figure 6B:
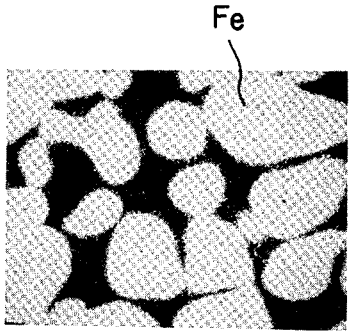
Figure 6C:
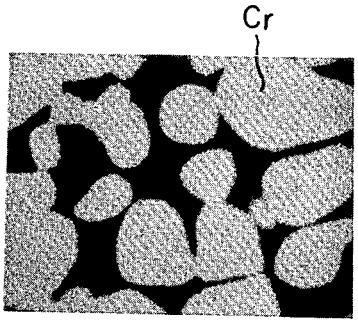
Figure 6D:
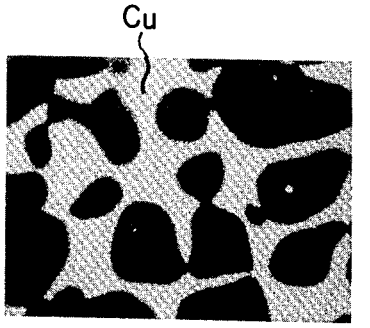
Figure 7A:
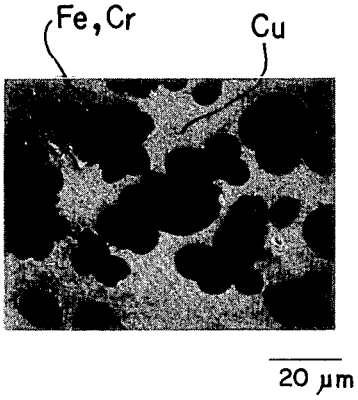
Figure 7B:
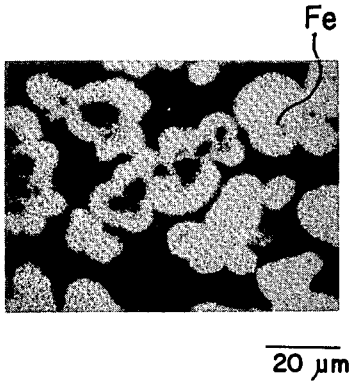
Figure 7C:
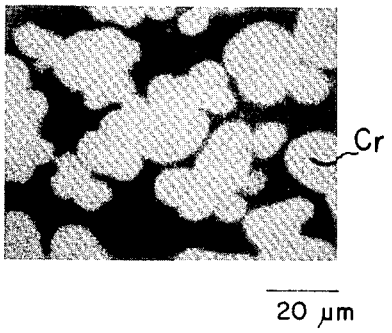
Figure 7D:
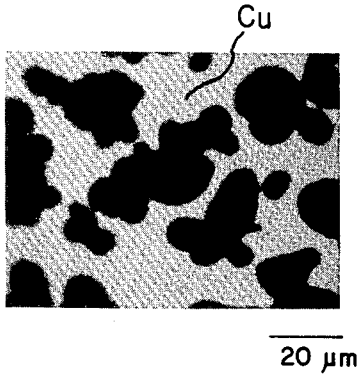

FIG. 5A shows a secondary electron image of a metal structure of Example $A_1$. FIG. 5B shows a characteristic X-ray image of distributed and diffused iron, in which distributed white or gray insular agglomerates indicate iron. FIG. 5C shows a characteristic X-ray image of distributed and diffused chromium, in which distributed gray insular agglomerates indicate chromium. FIG. 5D shows a characteristic X-ray image of infiltrant copper, in which white parts indicate copper.

Example $A_2$ of a complex metal for the magnetically arc-rotating portion 13 possesses a composition consisting of 50% copper by weight, 25% chromium by weight and 25% iron by weight.

FIGS. 6A, 6B, 6C and 6D show similar images to those of FIGS. 5A, 5B, 5C and 5D, respectively.

Example $A_3$ of a complex metal for the magnetically arc-rotating portion 13 possesses a composition of consisting of 50% copper by weight, 40% chromium by weight and 10% iron by weight.

FIGS. 7A, 7B, 7C and 7D show similar images to those of FIGS. 5A, 5B, 5C and 5D, respectively.

As apparent from FIGS. 5A to 5D, FIGS. 6A to 6D and FIGS. 7A to 7D, the chromium and the iron are uniformly distributed and diffused into each other in the metal structure, thus forming many insular agglomerates. The agglomerates are uniformly bonded to each other throughout the metal structure, resulting in the porous matrix consisting of chromium and iron. Interstices of the porous matrix are infiltrated with copper, which results in a stout structure of the complex metal for the magnetically arc rotating portion 13.

FIGS. 8A to 8D, FIGS. 9A to 9D and FIGS. 10A to 10D show structures of the complex metals for the contact-making portion 14 according to the 2nd to 10th embodiments of the present invention.

According to the 2nd to 10th embodiments of the present invention, a contact-making portion 14 is made of material of 20 to 60% IACS electrical conductivity and 120 to 180 Hv hardness, e.g., metal composition consisting of 20 to 70% copper by weight, 5 to 70% chromium by weight and 5 to 70% molybdenum by weight. The complex metals for the contact-making portion 14 are produced substantially by the same processes as those for producing the magnetically arc-rotating portion 13.

Referred to FIGS. 8A to 8D, FIGS. 9A to 9D and FIGS. 10A to 10D which are photographs by the X-ray microanalyzer as well as FIGS. 5A to 5D, structures of the complex metals for the contact-making portion 14 which are produced according to substantially the same process as the first infiltration process above, will be described hereinafter.

Example $C_1$ of a complex metal for the contact-making portion possesses a composition consisting of 50% copper by weight, 10% chromium by weight and 40% molybdenum by weight.

Figure 8A:
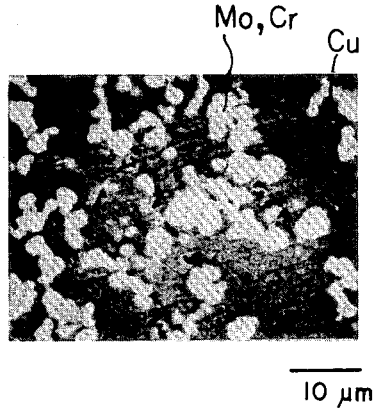
Figure 8B:
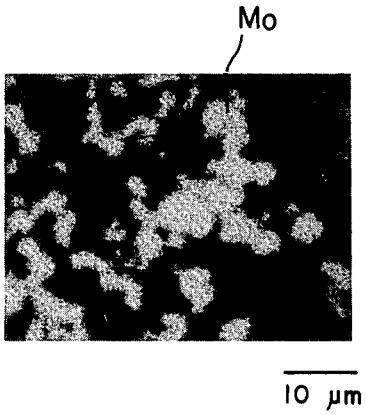
Figure 8C:
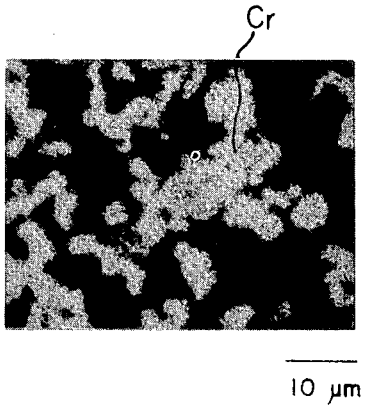
Figure 8D:
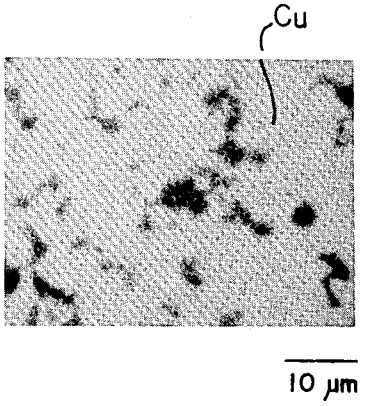
Figure 9A:
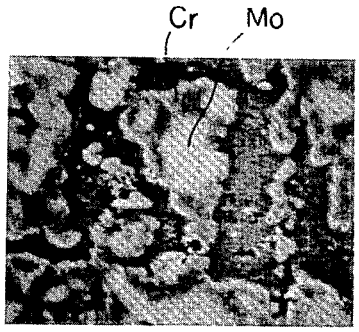
Figure 9B:
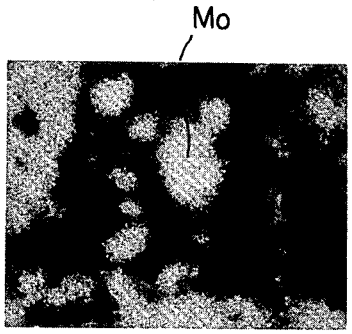
Figure 9C:
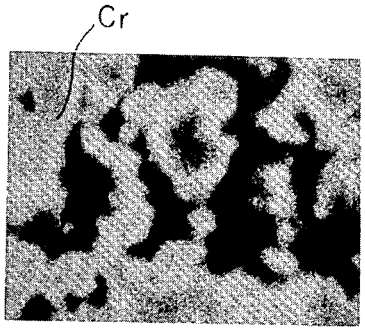
Figure 9D:
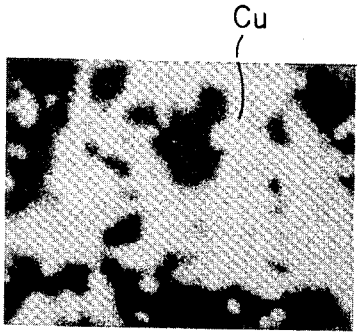
Figure 10A:
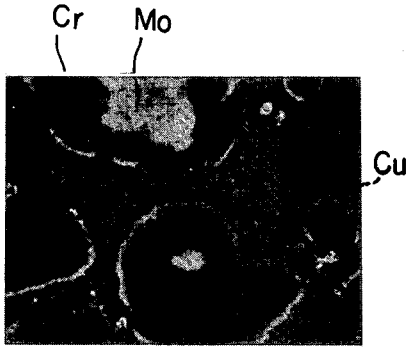
Figure 10B:
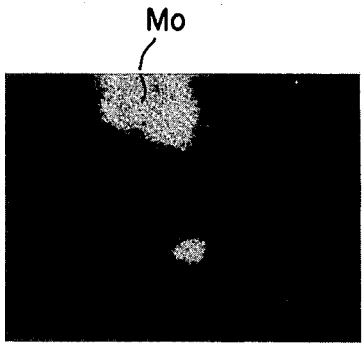
Figure 10C:
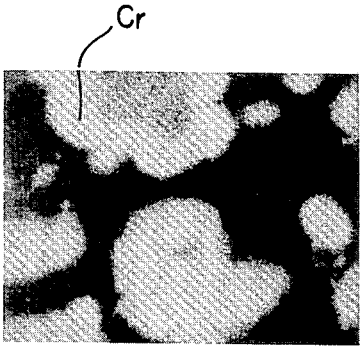
Figure 10D:
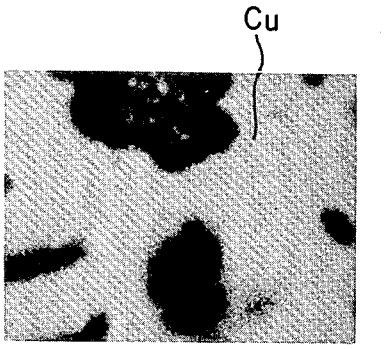

FIG. 8A shows a secondary electron image of a metal structure of Example $C_1$. FIG. 8B shows a characteristic X-ray image of distributed and diffused molybdenum, in which distributed gray insular agglomerates indicate molybdenum. FIG. 8C shows a characteristic X-ray image of distributed and diffused chromium, in which distributed gray or white insular agglomerates indicate chromium. FIG. 8D shows a characteristic X-ray image of infiltrant copper, in which white parts indicate copper.

Example $C_2$ of a complex metal for the contact-making portion 14 possesses a composition consisting of 50% copper by weight, 25% chromium by weight and 25% molybdenum by weight.

FIGS. 9A, 9B, 9C and 9D show similar images to those of FIGS. 8A, 8B, 8C and 8D, respectively.

Example $C_3$ of a complex metal for the contact-making portion 14 possesses a composition consisting of 50% copper by weight, 40% chromium by weight and 10% molybdenum by weight.

FIGS. 10A, 10B, 10C and 10D show similar images to those of FIGS. 8A, 8B, 8C and 8D, respectively.

As apparent from FIGS. 8A to 8D, FIGS. 9A to 9D and FIGS. 10A to 10D, the chromium and molybdenum are uniformly distributed and diffused into each other in the metal structure, thus forming many insular agglomerates. The agglomerates are uniformly bonded to each other throughout the metal structure, thus resulting in the porous matrix consisting of chromium and molybdenum. Interstices of the porous matrix are infiltrated with copper, which results in a stout structure of the complex metal for the contact-making portion 14.

Measurements which were carried out on Examples $A_1$, $A_2$ and $A_3$ of the complex metal for the magnetically arc-rotating portion 13, established that they possessed 8 to 10% IACS electrical conductivity, at least 294 MPa (30 kgf/mm$^2$) tensile strength and 100 to 170 Hv hardness.

On the other hand, the measurements which were carried out on Examples $C_1$, $C_2$ and $C_3$ possessed 40 to50% IACS electrical conductivity and 120 to 180 Hv hardness.

A contact-making portion of a 1st comparative is made of 20Cu-80W alloy. A contact-making portion of a 2nd comparative is made of Cu-0.5Bi alloy.

Examples $A_1$, $A_2$ and $A_3$ of the complex metal for the magnetically arc-rotating portion 13 were respectively shaped into discs, each of which has a diameter of 100 mm and eight fingers 17 as shown in FIGS. 2 and 3, and, Examples $C_1$, $C_2$ and $C_3$ of the complex metal for the contact-making portion 14, which are shown and described above, a 20Cu-80W alloy and a Cu-0.5Bi alloy for the contact-making portion 14 were respectively shaped into annular bodies, each of which has an inner-diameter of 30 mm and an outer-diameter of 60 mm. The discs of Examples $A_1$, $A_2$, $A_3$ and copper, and the annular bodies of Examples $C_1$, $C_2$, $C_3$, the 20Cu-80W alloy and the Cu-0.5Bi alloy were all paired off, resulting in fourteen electrodes. A pair of electrodes made up in the above manner was assembled into a vacuum interrupter of the magnetically arc-rotating type as illustrated in FIG. 1. Tests were carried out on performances of this vacuum interrupter. The results of the tests will described hereinafter. A description shall be made on a vacuum interrupter of a 5th embodiment of the present invention which includes a pair of electrodes each consisting of a magnetically arc-rotating portion made of Example $A_2$, and a contact-making portion made of Example $C_1$. A magnetically arc-rotating portion and a contact-making portion of an electrode of a 2nd embodiment are made of respective Examples $A_1$ and $C_1$. Those of a 3rd, of Examples $A_1$ and $C_2$. Those of a 4th, of Examples $A_1$ and $C_3$. Those of a 6th, of Examples $A_2$ and $C_2$. Those of a 7th, of Examples $A_2$ and $C_3$. Those of an 8th, of Examples $A_3$ and $C_1$. Those of a 9th, of Examples $A_3$ and $C_2$. Those of a 10th, of Examples $A_3$ and $C_3$. Those of a 1st comparative, of Example $A_2$ and 20Cu-80W alloy. Those of a 2nd comparative, of Example $A_2$ and Cu-0.5Bi alloy.

When performances of the vacuum interrupters of the 2nd to 4th and 6th to 10th embodiments of the present invention differ from those of the 5th embodiment of the present invention, then different points shall be specified.

(6) Large-current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted 45 kA current. Moreover, interruption tests at an opening speed of 3.0 m/s under a rated voltage of 84 kV, however, a transient recovery voltage of 143 kV according to JEC-181, established that the test vacuum interrupters interrupted 35 kA current.

Table 1 below shows the results of the large-current interrupting capability tests. Table 1 also shows those of vacuum interrupters of 3rd to 5th comparatives which include a pair of electrodes each consisting of a magnetically arc-rotating portion and a contact-making portion, as well as those of vacuum interrupters of the 1st and 2nd comparatives. The magnetically arc-rotating and contact-making portions of the vacuum interrupters of the 1st to 5th comparative have the same sizes as those of the respective magnetically arc-rotating portion and contact-making portion of the 2nd to 10th embodiments of the present invention.

A magnetically arc-rotating portion and a contact-making portion of an electrode of a 3rd comparative are made of respective copper and Example $C_1$. Those of a 4th comparative, of copper and 20Cu-80W alloy. Those of a 5th comparative, of copper and Cu-0.5Bi alloy.

TABLE 1

| Embodiment | Electrode: Magnetically Arc-rotating Portion | Electrode: Contact-making Portion | Large Current Interrupting Capability 12 kV | Large Current Interrupting Capability 84 kV |
|---|---|---|---|---|
| No. | | Example | | |
| 2 | Example $A_1$ | $C_1$ | 41 | 32 |
| 3 | Example $A_1$ | $C_2$ | 40 | 31 |
| 4 | Example $A_1$ | $C_3$ | 40 | 30 |
| 5 | Example $A_2$ | $C_1$ | 45 | 35 |
| 6 | Example $A_2$ | $C_2$ | 45 | 35 |
| 7 | Example $A_2$ | $C_3$ | 45 | 35 |
| 8 | Example $A_3$ | $C_1$ | 42 | 33 |
| 9 | Example $A_3$ | $C_2$ | 43 | 31 |
| 10 | Example $A_3$ | $C_3$ | 41 | 30 |
| Comparative | | | | |
| 1 | Example $A_2$ | 20Cu—80W | 12 | 8 |
| 2 | Example $A_2$ | Cu—0.5Bi | 37 | 26 |
| 3 | copper | Example $C_1$ | 38 | 28 |
| 4 | copper | 20Cu—80W | 8 | 6 |
| 5 | copper | Cu—0.5Bi | 35 | 25 |

(7) Dielectric strength

In accordance with JEC-181 test method, impulse withstand voltage tests were carried out with a 30 mm inter-contact gap. The vacuum interrupters showed 250 kV withstand voltage against both positive and negative impulses with a ±10 kV deviation.

After interrupting 45 kA current of rated 12 kV for 10 times, the same impulse withstand voltage tests were carried out, establishing the same results.

After continuously opening and closing a circuit through which 80 A leading small current of rated 12 kV flowed, the same impulse withstand voltage tests were carried out, establishing substantially the same results.

Table 2 below shows the results of the tests of the impulse withstand voltage tests which were carried out on the vacuum interrupters of the 5th embodiment of the present invention. Table 2 also shows those of the vacuum interrupters of the 1st to 5th comparatives.

TABLE 2

| Embodiment | Electrode: Magnetically Arc-rotating Portion | Electrode: Contact-making Portion | Withstand Voltage kV |
|---|---|---|---|
| No. 5 | Example $A_2$ | Example $C_1$ | ±250 |
| Comparative | | | |
| 1 | Example $A_2$ | 20Cu—80W | ±250 |
| 2 | Example $A_2$ | Cu—0.5Bi | ±200 |
| 3 | copper disc | Example $C_1$ | ±250 |
| 4 | copper disc | 20Cu—80W | ±250 |
| 5 | copper disc | Cu—0.5Bi | ±200 |

(8) Anti-Welding capability

In accordance with the IEC rated short time current, current of 25 kA was passed for 3s through the stationary and movable electrodes 5 and 6 which were forced to contact each other under 1275N (130 kgf) force. The stationary and movable electrodes 5 and 6 were then separated without any failures with 1961N (200 kgf) static separating force. An increase of electrical contact resistance was then limited to within 2 to 8%.

In accordance with the IEC short time current, current of 50 kA was passed for 3 s through the stationary and movable electrodes 5 and 6 which were forced to contact each other under 9807N (1,000 kgf) force. The stationary and movable electrodes 5 and 6 were then separated without any failures with a 1961N (200 kgf) static separating force. Electrical contact resistance was zero or increased at most by 5%. Thus, the stationary and movable electrodes 5 and 6 actually possess good anti-welding capability.

(9) Lagging small current interrupting capability

In accordance with a lagging small current interrupting test standard of JEC-181, a 30 A test current of $$84 \times \frac{1.5}{\sqrt{3}} \text{ kV}$$

was passed through the stationary and movable electrodes 5 and 6. The average current chopping value was 3.9 A (however, a standard deviation $\sigma_n = 0.96$ and a sample number n=100).

However, the average current chopping values of the vacuum interrupters of the 6th and 7th embodiments of the present invention were 3.7 A (however, $\sigma_n = 1.50$ and n=100) and 3.9 A (however, $\sigma_n = 1.50$ and n=100).

(10) Leading small current interrupting capability

In accordance with a leading small current interrupting test standard of JEC-181, a test leading small current of 80 A at $$84 \times \frac{1.25}{\sqrt{3}} \text{ kV}$$

was passed through the stationary and movable electrodes 5 and 6. Under that condition a continuously 10,000 times opening and closing test was carried out. No reignition was established.

The following limits were apparent on a composition ratio of each metal in the complex metal for the magnetically arc-rotating portion.

Copper below 20% by weight significantly lowered the current interrupting capability. On the other hand, copper above 70% by weight significantly lowered the mechanical and dielectric strengths of the magnetically arc-rotating portion but increased the electrical conductivity thereof, thus significantly lowering the current interrupting capability.

Chromium below 5% by weight increased the electrical conductivity of the magnetically arc-rotating portion, thus significantly lowering the current interrupting capability and the dielectric strength. On the other hand, chromium above 40% by weight significantly lowered the mechanical strength of the magnetically arc-rotating portion.

Iron below 5% by weight significantly lowered the mechanical strength of the magnetically arc-rotating portion. On the other hand, iron above 40% by weight significantly lowered the current interrupting capability.

The following limits were apparent on a composition ratio of each metal in the complex metal for the contact-making portion.

Copper below 20% by weight significantly lowered the electrical conductivity of the contact-making portion but significantly increased the electrical contact resistance thereof. On the other hand, copper above 70% by weight significantly increased the current chopping value but significantly lowered the anti-welding capability and the dielectric strength.

Chromium below 5% by weight significantly lowered the dielectric strength. On the other hand, chromium above 70% by weight significantly decreased the electrical conductivity and the mechanical strength of the contact-making portion.

Molybdenum below 5% by weight significantly lowered the dielectric strength. On the other hand, molybdenum above 70% by weight significantly lowered the mechanical strength of the contact-making portion but significantly increased the current chopping value.

According to the 2nd to 10th embodiments of the present invention, the increased tensile strength of the magnetically arc-rotating portion significantly decreases a thickness and weight of the contact-making portion and much improves the durability of the contact-making portion.

According to them too, the magnetically arc-rotating portion, which is made of material of high mechanical strength, make possible for the fingers thereof to be longer without increasing an outer-diameter of the magnetically arc-rotating portion, thus much enhancing a magnetically arc-rotating force.

According to them still too, the magnetically arc-rotating portion, which is made of complex metal of high hardness in which each constituent is uniformly distributed, prevents the fingers from excessively melting thus significantly reducing the erosion thereof.

Thus, the recovery voltage characteristic is improved and there is little the lowering of the dielectric strength even after many current interruptions. For example, the lowering of the dielectric strength after 10,000 interruptions amounts to 10 to 20% of the dielectric strength before interruption, thus decreasing the current chopping value too.

FIGS. 11A to 11D and FIGS. 12A to 12D show structures of the complex metals for the magnetically arc-rotating portion.

According to the 11th to 28th embodiments of the present invention, the magnetically arc-rotating portions are made of a complex metal consisting of 30 to 70% magnetic stainless steel by weight and 30 to 70% copper by weight. For example, ferritic stainless or martensitic stainless steel is used as a magnetic stainless steel. As a ferritic stainless steel, SUS405, SUS429, SUS430, SUS430F or SUS405 may be listed. As a martensitic stainless steel, SUS403, SUS410, SUS416, SUS420, SUS431 or SUS440C may be listed.

The complex metal above consisting of a 30 to 70% magnetic stainless steel and 30 to 70% copper by weight, possesses at least 294 MPa (30 kgf/mm$^2$) tensile strength and 180 Hv hardness. This complex metal possesses 3 to 30% IACS electrical conductivity when a ferritic stainless steel was used, while 4 to 30% IACS electrical conductivity when a martensitic stainless steel was used.

Complex metals for the magnetically arc-rotating portion 13 of the 11th to 28th embodiments of the present invention were produced by substantially the same process as the first infiltration process.

The contact-making portions 14 of the contact-electrodes of the 11th to 28th embodiments of the present invention are made of the same complex metal as those for the contact-making portions of the contact-electrodes of the 2nd to 10th embodiments of the present invention.

The contact-making portions of the contact-electrodes of the 6th and 7th comparatives are made of CU-0.5Bi alloy. The contact making portions of the electrodes of the 8th and 9th comparatives are made of 20Cu-80W alloy.

Referred to FIGS. 11A to 11D and FIGS. 12A to 12D which are photographs by the X-ray microanalyzer, structures of the complex metals for the magnetically arc-rotating portion which were produced by substantially the same process as the first infiltration process, will be described hereinafter.

Examples $A_4$ of a complex metal for the magnetically arc-rotating portion possesses a composition consisting of 50% ferritic stainless steel SUS434 and 50% copper by weight.

Figure 11A:
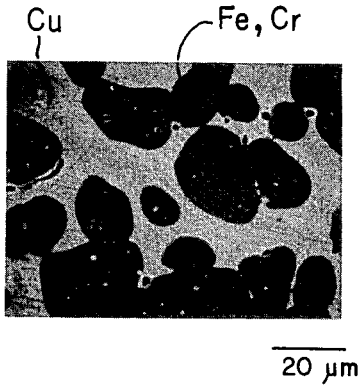
Figure 11B:
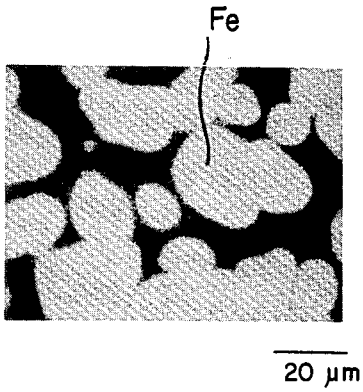
Figure 11C:
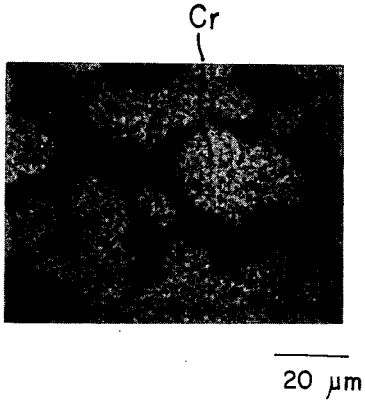
Figure 11D:
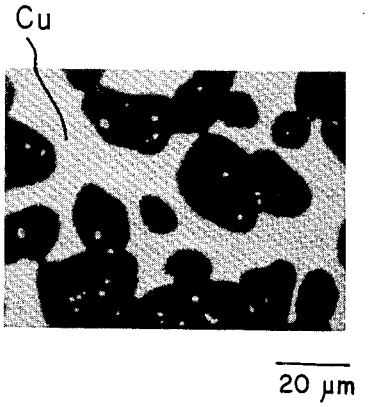
Figure 12A:
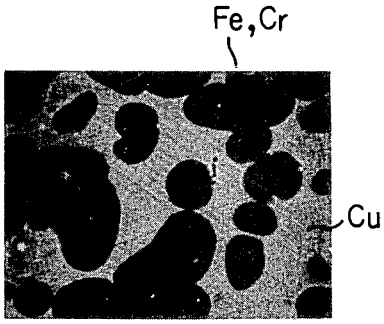
Figure 12B:
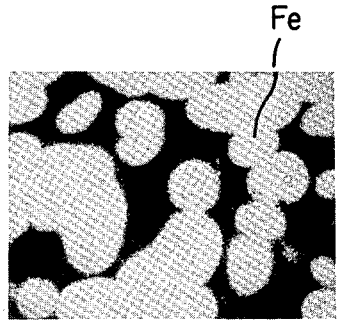
Figure 12C:
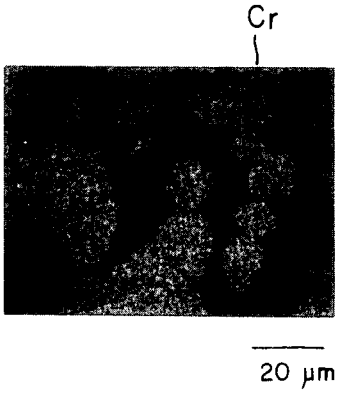
Figure 12D:
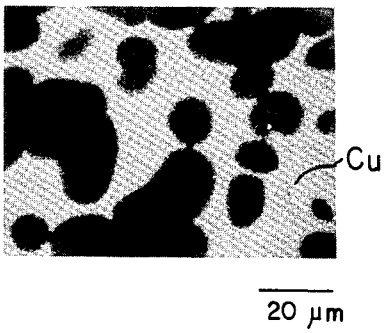

FIG. 11A shows a secondary electron image of a metal structure of Example $A_4$. FIG. 11B shows a characteristic X-ray image of distributed iron, in which distributed white insular agglomerates indicate iron. FIG. 11C shows a characteristic X-ray image of distributed chromium, in which distributed gray insular agglomerates indicate chromium. FIG. 11D shows a characteristic X-ray image of infiltrant copper, in which white parts indicate copper.

As apparent from FIGS. 11A to 11D, the particles of ferritic stainless steel SUS434 are bonded to each other, resulting in a porous matrix. Interstices of the porous matrix are infiltrated with copper, which results in a stout structure of the complex metal for the magnetically arc-rotating portion.

Example $A_7$ of a complex metal for the magnetically arc-rotating portion possesses a composition consisting of 50% martensitic stainless steel SUS410 by weight and 50% copper by weight.

FIGS. 12A, 12B, 12C and 12D show similar images to those of FIGS. 11A, 11B, 11C and 11D, respectively.

Structures of the complex metals of FIGS. 12A to 12D are similar to those of FIGS. 11A to 11B.

Example $A_5$ of a complex metal for the magnetically arc-rotating portion possesses a composition consisting of 70% ferritic stainless steel SUS434 by weight and 30% copper by weight. Example $A_6$, of 30% ferritic stainless steel SUS434 by weight and 70% copper by weight. Example $A_8$, of 70% martensitic stainless steel SUS410 by weight and 30% copper by weight. Example $A_9$, of 30% martensitic stainless steel SUS410 by weight and 70% copper by weight.

Examples $A_5$, $A_6$, $A_8$ and $A_9$ of the complex metal for the magnetically arc-rotating portion were produced by substantially the same process as the first infiltration process.

Measurements of IACS electrical conductivity which were carried out on Examples $A_4$ to $A_9$ of the complex metal for the magnetically arc-rotating portion and Examples $C_1$ to $C_3$ above of the complex metal for the contact-making portion established that:

Example $A_4$, 5 to 15% IACS electrical conductivity
Example $A_5$, 3 to 8%
Example $A_6$, 10 to 30%
Example $A_7$, 5 to 15%
Example $A_8$, 4 to 8%
Example $A_9$, 10 to 30%
Example $C_1$, 40 to 50%
Example $C_2$, 40 to 50%
Example $C_3$, 40 to 50%.

Respective measurements of tensile strength and hardness established that Example $A_4$ of the complex metal for the magnetically arc-rotating portion possessed 294 MPa (30 kgf/mm$^2$) tensile strength and 100 to 180 Hv hardness.

Examples $A_4$ to $A_9$ of the complex metal for the magnetically arc-rotating portion 13 and Examples $C_1$ to $C_3$ of the complex metal for the contact-making portion 14 are respectively shaped to the same shapes as those of the magnetically arc-rotating portion and the contact-making portion of the 2nd to 10th embodiments of the present invention, and tested as a pair of electrodes in the same manner as in the 2nd and 10th embodiments of the present invention. Results of the test will be described hereinafter. A description shall be made on a vacuum interrupter of a 11th embodiment of the present invention which includes the pair of electrodes each consisting of a magnetically arc-rotating portion 13 made of Example $A_4$, and a contact-making portion 14 made of Example $C_1$. A magnetically arc-rotating portion 13 and a contact-making portion 14 of an electrode of a 12th embodiment are made of respective Examples $A_4$ and $C_2$. Those of a 13th, of Examples $A_4$ and $C_3$. Those of a 14th, of Examples $A_5$ and $C_1$. Those of a 15th, of Examples $A_5$ and $C_2$. Those of a 16th, of Examples $A_5$ and $C_3$. Those of a 17th, of Examples $A_6$ and $C_1$. Those of a 18th, of Examples $A_6$ and $C_2$. Those of a 19th, of Examples $A_6$ and $C_3$. Those of a 20th, of Examples $A_7$ and $C_1$. Those of a 21st, of Examples $A_7$ and $C_2$. Those of a 22nd, of Examples $A_7$ and $C_3$. Those of a 23rd, of Examples $A_8$ and $C_1$. Those of a 24th, of Examples $A_8$ and $C_2$. Those of a 25th, of Examples $A_8$ and $C_3$. Those of a 26th, of Examples $A_9$ and $C_1$. Those of a 27th, of Examples $A_9$ and $C_2$. Those of a 28th, of Examples $A_9$ and $C_3$. Those of a 6th comparative, of Example $A_4$ and Cu-0.5Bi alloy. Those of a 7th comparative, of Example $A_7$ and Cu-0.5Bi alloy. Those of a 8th comparative, of Example $A_4$ and 20Cu-80W alloy. Those of a 9th comparative, of Example $A_7$ and 20Cu-80W alloy.

When performances of the vacuum interrupters of the 12th to 28th embodiments of the present invention differ from those of the 11th embodiment of the present invention, then different points shall be specified.

(11) Large current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted, 45 kA current. Moreover, interruption tests at an opening speed of 3.0 m/s under a rated voltage of 84 kV, however, a transient recovery voltage of 143 kV according to JEC-181, established that the test vacuum interrupters interrupted 35 kA current.

Table 3 below shows the results of the large current interrupting capability tests on vacuum interrupters of the 11th to 28th embodiments of the present invention and vacuum interrupters of the 6th to 9th comparatives.

TABLE 3

| Embodiment | Electrode: Magnetically Arc-rotating Portion | Electrode: Contact-making Portion | Large Current Interrupting Capability kA: 12 kV | Large Current Interrupting Capability kA: 84 kV |
|---|---|---|---|---|
| No. | | Example | | |
| 11 | Example $A_4$ | $C_1$ | 45 | 35 |
| 12 | Example $A_4$ | $C_2$ | 46 | 35 |
| 13 | Example $A_4$ | $C_3$ | 43 | 30 |
| 14 | Example $A_5$ | $C_1$ | 40 | 28 |
| 15 | Example $A_5$ | $C_2$ | 41 | 28 |
| 16 | Example $A_5$ | $C_3$ | 43 | 30 |
| 17 | Example $A_6$ | $C_1$ | 42 | 27 |

TABLE 3-continued

| Embodiment | Electrode: Magnetically Arc-rotating Portion | Electrode: Contact-making Portion | Large Current Interrupting Capability kA: 12 kV | Large Current Interrupting Capability kA: 84 kV |
|---|---|---|---|---|
| 18 | Example $A_6$ | $C_2$ | 40 | 25 |
| 19 | Example $A_6$ | $C_3$ | 44 | 31 |
| 20 | Example $A_7$ | $C_1$ | 45 | 35 |
| 21 | Example $A_7$ | $C_2$ | 44 | 34 |
| 22 | Example $A_7$ | $C_3$ | 43 | 34 |
| 23 | Example $A_8$ | $C_1$ | 41 | 30 |
| 24 | Example $A_8$ | $C_2$ | 42 | 32 |
| 25 | Example $A_8$ | $C_3$ | 42 | 32 |
| 26 | Example $A_9$ | $C_1$ | 42 | 32 |
| 27 | Example $A_9$ | $C_2$ | 42 | 30 |
| 28 | Example $A_9$ | $C_3$ | 41 | 30 |
| Comparative | | | | |
| 6 | Example $A_4$ | Cu—0.5Bi | 35 | 25 |
| 7 | Example $A_7$ | Cu—0.5Bi | 35 | 25 |
| 8 | Example $A_4$ | 20Cu—80W | 13 | 8 |
| 9 | Example $A_7$ | 20Cu—80W | 11 | 8 |

(12) Dielectric strength

In accordance with JEC-181 test method, impulse withstand voltage tests were carried out with a 30 mm inter-contact gap. The results showed 280 kV withstand voltage against both positive and negative impulses with a ±10 kV deviation.

After interrupting 45 kA current of rated 12 kV 10 times, the same impulse withstand voltage tests were carried out, establishing the same results.

After continuously opening and closing a circuit 100 times through which 80 A leading small current of rated 12 kV flowed, the same impulse withstand voltage tests were carried out, establishing substantially the same results.

Table 4 below shows the results of the tests of the impulse withstand voltage at a 30 mm inter-contact gap which were carried out on the vacuum interrupters of the 11th and 14th embodiments of the present invention, and the 6th and 8th comparatives.

TABLE 4

| Embodiment | Electrode: Magnetically Arc-rotating Portion | Electrode: Contact-making Portion | Withstand Voltage kV |
|---|---|---|---|
| No. | Example | | |
| 11 | $A_4$ | Example $C_1$ | ±280 |
| 14 | $A_5$ | Example $C_1$ | ±280 |
| Comparative | | | |
| 6 | $A_4$ | Cu—0.5Bi | ±200 |
| 8 | $A_4$ | 20Cu—80W | ±250 |

(13) Anti-welding capability

The same as in the item (8).

(14) Lagging small current interrupting capability

In accordance with a lagging small current interrupting test of JEC-181, a 30 A test current of $$84 \times \frac{1.5}{\sqrt{3}} \text{ kV}$$

was flowed through the stationary and movable contact-electrodes 5 and 6. Current chopping values had a 3.9 A average (however, a standard deviation $\sigma_n = 0.96$ and a sample number n = 100).

In particular, current chopping values of the vacuum interrupters of the 12th, 15th, 18th, 21st, 24th and 27th embodiments of the present invention had a 3.7 A (however, $\sigma_n = 1.26$ and n=100) average, respectively, and current chopping values of the vacuum interrupters of the 13th, 16th, 19th, 22nd, 24th and 28th embodiments of the present invention had respective a 3.9 (however, $\sigma_n = 1.50$ and n=100) average, respectively.

(15) Leading small current interrupting capability

The same as in the item (10).

The following limits were apparent on a composition ratio of magnetic stainless steel in the complex metal for the magnetically arc-rotating portion of the 11th to 28th embodiments of the present invention.

Magnetic stainless steel below 30% by weight significantly decreased the dielectric strength and the mechanical strength and durability of the magnetically arc-rotating portion 13, so that the magnetically arc-rotating portion 13 had to be thickened.

On the other hand, magnetic stainless steel above 70% by weight significantly lowered interruption performance.

The 11th to 28th embodiments of the present invention effect the same advantages as the 2nd to 10th embodiments of the present invention do.

FIGS. 13A to 13E show structures of the complex metals for the magnetically arc-rotating portion 13 of the 29th to 37th embodiments of the present invention.

Magnetically arc-rotating portions 13 of the 29th to 37th embodiments of the present invention are made of a complex metal consisting of 30 to 70% austinitic stainless steel by weight and 30 to 70% copper by weight. As an austinitic stainless steel, SUS304, SUS304L, SUS316 or SUS316L may be, for example, used.

The complex metal consisting of 30 to 70% austinitic stainless steel by weight and 30 to 70% copper by weight possesses 4 to 30% IACS electrical conductivity, at least 294 MPa (30 kgf/mm$^2$) tensile strength and 100 to 180 Hv hardness.

The complex metals for the magnetically arc-rotating portion 13 of the 29th to 37th embodiments of the present invention were produced by substantially the same as the first infiltration process.

Contact-making portions 14 of the 29th to 37th embodiments of the present invention are made of the complex metal of the same composition as that of the complex metal of the 2nd to 10th embodiments of the present invention.

Referred to FIGS. 13A to 13E which are photographs by the X-ray microanalyzer, structures of the complex metals for the magnetically arc-rotating portion which were produced by substantially the same process as the first infiltration process, will be described hereinafter.

Example $A_{10}$ of a complex metal for the arc-rotating portion possesses a composition consisting of 50% austinitic stainless steel SUS304 by weight and 50% copper by weight.

Figure 13A:
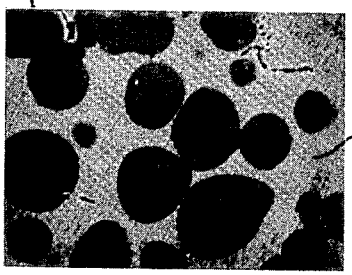
Figure 13B:
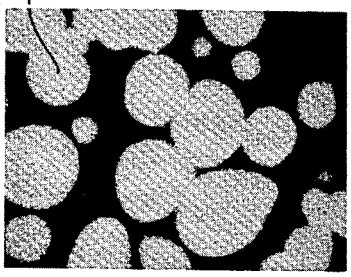
Figure 13C:
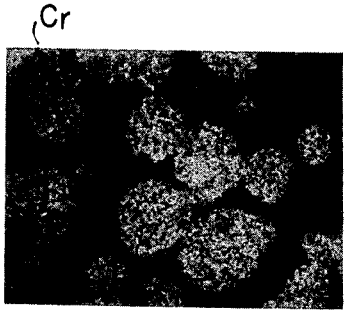
Figure 13D:
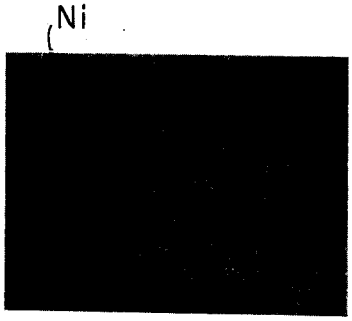
Figure 13E:
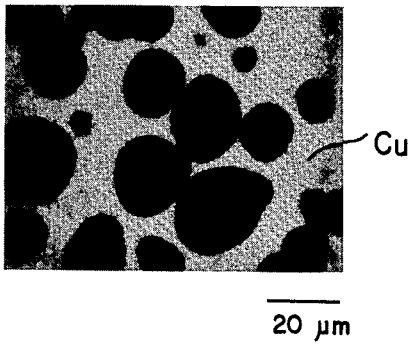

FIG. 13A shows a secondary electron image of a metal structure of Example $A_{10}$. FIG. 13B shows a characteristic X-ray image of distributed iron, in which distributed white insular agglomerates indicate iron. FIG. 13C shows a characteristic X-ray image of distributed chromium, in which distributed gray insular agglomerates indicate chromium. FIG. 13D shows a characteristic X-ray image of distributed nickel, in which distributed gray insular agglomerates indicate nickel. FIG. 13E shows a charcteristic X-ray image of infiltrant copper, in which white parts indicate copper.

As apparent from FIGS. 13A to 13E, the particles of austinitic stainless steel SUS304 are bonded to each other, resulting in a porous matrix. Interstices of the porous matrix are infiltrated with copper, which results in a stout structure of the complex metal for the magnetically arc-rotating portion.

Example $A_{11}$ of a complex metal for the magnetically arc-rotating portion possesses a composition consisting of 70% austinitic stainless steel SUS304 by weight and 30% copper by weight.

Example $A_{12}$ of a complex metal for the magnetically arc-rotating portion possesses a composition consisting of 30% austinitic stainless steel SUS304 by weight and 70% copper by weight.

Measurements of IACS electrical conductivity which were carried out on Examples $A_{10}$ to $A_{12}$ of the complex metal for the magnetically arc-rotating portion established that:

Example $A_{10}$, 5 to 15% IACS electrical conductivity
Example $A_{11}$, 4 to 8%
Example $A_{12}$, 10 to 30%

Examples $A_{10}$ to $A_{12}$ of the complex metal for the magnetically arc-rotating portion 13 and Examples $C_1$ to $C_3$ of the complex metal for the contact-making portion 14 are respectively shaped to the same as those of the magnetically arc-rotating portion and the contact-making portion of the 2nd to 10th embodiments of the present invention, and tested as a pair of electrodes in the same manner as in the 2nd and 10th embodiments of the present invention. Results of the test will be described hereinafter. A description shall be made on a vacuum interrupter of a 29th embodiment of the present invention which includes a pair of electrodes each consisting of a magnetically arc-rotating portion 13 made of Example $A_{10}$, and a contact-making portion 14 made of Example $C_1$. A magnetically arc-rotating portion and a contact-making portion of an electrode of a 30th embodiment are made of respective Examples $A_{10}$ and $C_2$. Those of a 31st, of Examples $A_{10}$ and $C_3$. Those of a 32nd, of Examples $A_{11}$ and $C_1$. Those of a 33rd, of Examples $A_{11}$ and $C_2$. Those of a 34th, of Examples $A_{11}$ and $C_3$. Those of a 35th, of Examples $A_{12}$ and $C_1$. Those of a 36th, of Examples $A_{12}$ and $C_2$. Those of a 37th, of Examples $A_{12}$ and $C_3$. When performances of the vacuum interrupters of the 30th to 37th embodiments of the present invention differ from those of the 29th embodiment of the present invention, then different points shall be specified.

(16) Large current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted, 43 kA current. Moreover, interruption tests at an opening speed of 3.0 m/s under a rated voltage of 84 kV, however, a transient recovery voltage of 143 kV according to JEC-181, established that the test vacuum interrupters interrupted 32 kA current.

Table 5 below shows the results of the large current interrupting capability tests which were carried out on the vacuum interrupters of the 29th to 37th embodiments. Table 5 also shows those of vacuum interrupters of the 10th and 11th comparatives which include a pair of electrodes each consisting of a magnetically arc-rotating portion and a contact-making portion each having the same sizes as those of magnetically arc-rotating portions of the electrodes of the 29th to 37th embodiments of the present invention.

A magnetically arc-rotating portion and a contact-making portion of the 10th comparative are respectively made of Example $A_{10}$ and 20Cu-80W alloy. Those of the 11th comparative, of Example $A_{10}$ and Cu-0.5Bi alloy.

TABLE 5

| Embodiment | Electrode: Magnetically Arc-rotating Portion | Electrode: Contact-making Portion | Large Current Interrupting Capability kA: 12 kV | 84 kV |
|---|---|---|---|---|
| No. | | Example | | |
| 29 | Example $A_{10}$ | $C_1$ | 43 | 32 |
| 30 | Example $A_{10}$ | $C_2$ | 41 | 31 |
| 31 | Example $A_{10}$ | $C_3$ | 38 | 28 |
| 32 | Example $A_{11}$ | $C_1$ | 37 | 27 |
| 33 | Example $A_{11}$ | $C_2$ | 38 | 28 |
| 34 | Example $A_{11}$ | $C_3$ | 40 | 30 |
| 35 | Example $A_{12}$ | $C_1$ | 38 | 28 |
| 36 | Example $A_{12}$ | $C_2$ | 42 | 32 |
| 37 | Example $A_{12}$ | $C_3$ | 40 | 30 |
| Comparative | | | | |
| 10 | Example $A_{10}$ | 20Cu—80W | 11 | 7 |
| 11 | Example $A_{10}$ | Cu—0.5Bi | 35 | 25 |

(17) Dielectric strength

In accordance with JEC-181 test method, impulse withstand voltage tests were carried out with a 30 mm inter-contact gap. The vacuum interrupters showed 280 kV withstand voltage against both positive and negative impulses with a ±10 kV deviation.

After 10 times interrupting 43 kA current of rated 12 kV, the same impulse withstand voltage tests were carried out, thus establishing the same results.

After continuously opening and closing a circuit 100 times through which 80 A leading small current of rated 12 kV flowed, the same impulse withstand voltage tests were carried out, establishing substantially the same results.

Table 6 below shows the results of the tests of the impulse withstand voltage at a 30 mm inter-contact gap tests which were carried out on the vacuum interrupters of the 29th embodiment of the present invention and on them of the 10th and 11th comparatives.

TABLE 6

| Embodiment | Electrode: Magnetically Arc-rotating Portion | Electrode: Contact-making Portion | Withstand Voltage kV |
|---|---|---|---|
| No. 29 | Example $A_{10}$ | Example $C_1$ | ±280 |
| Comparative 10 | Example $A_{10}$ | 20Cu—80W | ±250 |
| Comparative 11 | Example $A_{10}$ | Cu—0.5Bi | ±200 |

(18) Anti-welding capability

The same as in the item (8).

(19) Lagging small current interrupint capability

In accordance with a lagging small current interrupting test of JEC-181, a 30 A test current of $$84 \times \frac{1.5}{\sqrt{3}} \text{ kV}$$

was passed through the stationary and movable electrodes 5 and 6. Current chopping values had a 3.9 A average (however, $\sigma_n=0.96$ and n=100).

In particular, current chopping values of the vacuum interrupters of the 30th, 33rd and 36th embodiments of the present invention had respectively a 3.7 A average (however, $\sigma_n=1.26$ and n=100), and those of the 31st, 34th and 37th embodiments of the present invention had a 3.9 A average (however $\sigma_n=1.50$ and n=100), respectively.

(20) Leading small current interrupting capability

The same as in the item (10).

The following limits were apparent on a composition ratio of austinitic stainless steel in the complex metals for the magnetically arc-rotating portion of the 29th to 37th embodiments of the present invention.

Austinitic stainless steel below 30% by weight significantly decreased the dielectric strength and the mechanical strength and durability of the magnetically arc-rotating portion 13, so that the magnetically arc-rotating portion had to be thickened.

On the other hand, austinitic stainless steel above 70% by weight significantly lowered interruption performance.

Magnetically arc-rotating portions 13 of the 38th to 40th embodiments are each made of a complex metal consisting of a porous structure of austinitic stainless steel including many holes of axial direction through the magnetically arc-rotating portions 13 at an areal occupation ratio of 10 to 90%, and copper or silver infiltrating the porous structure of austinitic stainless steel. This complex metal possesses 5 to 30% IACS electrical conductivity, at least 294 MPa (30 kgf/mm$^2$) tensile strength and 100 to 180 Hv hardness.

Complex metals for the magnetically arc-rotating portion of the 38th to 40th embodiments of the present invention were produced by the following process.

The Third Infiltration Process

Initially, a plurality of pipes of austinitic stainless steel, e.g., SUS304 or SUS316 and each having an outer-diameter within 0.1 to 10 mm and a thickness within 0.01 to 9 mm are heated at a temperature below a melting point of the austinitic stainless steel in a nonoxidizing atmosphere, e.g., a vacuum, or hydrogen, nitrogen or argon gas, thus bonded to each other so as to form a porous matrix of a circular section. Then, the resultant porous matrix of the circular section is placed in a vessel made of material, e.g., alumina ceramics, which interacts with none of the austinitic stainless steel, copper and silver. All the bores of the pipes and all the interstices between the pipes are infiltrated with copper or silver in the nonoxidizing atmosphere. After cooling, a desired complex metal for the magnetically arc-rotating portion was resultant.

The Fourth Infiltration Process

In place of the pipes in the third infiltration process, a plate of austinitic stainless steel and including many holes of vertical direction to the surfaces of the plate at an areal occupation ratio of 10 to 90% is used as a porous matrix. On the same subsequent steps as those of the third infiltration process, a desired complex metal for the magnetically arc-rotating portion was produced.

Contact-making portions of the 38th to 40th embodiments of the present invention are made of the complex metal of the same composition as that of the complex metal of the 2nd to 10th embodiments of the present invention.

Example $A_{13}$ of a complex metal for the magnetically arc-rotating portion possesses a composition consisting of 60% austinitic stainless steel SUS304 by weight and 40% copper by weight.

Example $A_{13}$ of the complex metal for the magnetically arc-rotating portion 13 and Examples $C_1$ to $C_3$ above of the complex metal for the contact-making portion were respectively shaped to the same as those of the magnetically arc-rotating portion 13 and the contact-making portion 14 of the 2nd embodiment of the present invention, and tested as a pair of electrodes in the same manner as in the 2nd and 10th embodiments of the present invention. Results of the tests will be described hereinafter. A description shall be made on a vacuum interrupter of a 38th embodiment of the present invention which includes a pair of electrodes each consisting of a magnetically arc-rotating portion made of Example $A_{13}$, and a contact-making portion made of Example $C_1$. A magnetically arc-rotating portion and a contact-making portion of an electrode of a 39th embodiment are made of respective Examples $A_{13}$ and $C_2$. Those of a 40th, of Examples $A_{13}$ and $C_3$.

When performances of the vacuum interrupters of the 39th and 40th embodiments of the present invention differ from those of the 38th embodiment of the present invention, then different points shall be specified.

(21) Large current interrupting capability

Interruption tests which were carried out at an opening speed within 1.2 to 1.5 m/s under a rated voltage of 12 kV, however, a transient recovery voltage of 21 kV according to JEC-181, established that the test vacuum interrupters interrupted 45 kA current. Moreover, interruption tests at an opening speed of 3.0 m/s under a rated voltage of 84 kV, however, a transient recovery voltage of 143 kV according to JEC-181, established that the test vacuum interrupters interrupted 30 kA current.

Table 7 below shows the results of the large current interrupting capability tests which were carried out on the vacuum interrupters of the 38th to 40th embodiments of the present invention.

TABLE 7

| | Electrode | | Large Current Interrupting Capability kA | |
|---|---|---|---|---|
| Embodiment | Magnetically Arc-rotating Portion | Contact-making Portion | 12 kV | 84 kV |
| No. | | Example | | |
| 38 | Example $A_{13}$ | $C_1$ | 45 | 30 |
| 39 | Example $A_{13}$ | $C_2$ | 46 | 32 |
| 40 | Example $A_{13}$ | $C_3$ | 46 | 31 |

(22) Dielectric strength

In accordance with JEC-181 test method, impulse withstand voltage tests were carried out with a 30 mm inter-contact gap. The results showed 250 kV withstand voltage against both positive and negative impulses with a ±10 kV deviation.

After interrupting 45 kA current of rated 12 kV 10 times, the same impulse withstand voltage tests were carried out, establishing the same results.

After continuously opening and closing a circuit 100 times through which 80A leading small current of rated 12 kV flowed, the same impulse withstand voltage tests were carried out, establishing substantially the same results.

(23) Anti-welding capability

The same as in the item (8).

(24) Lagging small current interrupting capability

The same tests as in the item (19) established that the vacuum interrupters of the 38th, 39th, and 40th embodiments of the present invention had respective 3.9A ($\sigma_n$=0.96 and n=100), 3.7A ($\sigma_n$=1.26 and n=100) and 3.9A ($\sigma_n$=1.50 and n=100) averages of current chopping value.

(25) Leading small current interrupting capability

The same as in the item (10).

In the complex metal for the magnetically arc-rotating portion of the 38th to 40th embodiments of the present invention the areal occupation ratio below 10% of many holes of axial direction in the plate of austinitic stainless steel significantly decreased the current interrupting capability, on the other hand, the areal occupation ratio above 90% thereof significantly decreased the mechanical strength of the magnetically arc-rotating portion and the dielectric strength of the vacuum interrupter.

The vacuum interrupters of the 38th to 40th of the present invention possess more improved high current interrupting capability than those of other embodiments of the present invention.

A vacuum interrupter of a magnetically arc-rotating type of the present invention, of which a contact-making portion of an electrode is made of a complex metal consisting of 20 to 70% copper by weight, 5 to 70% chromium by weight and 5 to 70% molybdenum by weight and of which a magnetically arc-rotating portion of the contact-electrode is made of material below, possesses more improved large current interrupting capability, dielectric strength, anti-welding capability, and lagging and leading small current interrupting capabilities than a conventional vacuum interrupter of a magnetically arc-rotating type.

There may be listed as a material for a magnetically rotating portion:

austinitic stainless steel of 2 to 3% IACS electrical conductivity, at least 481 MPa (49 kgf/mm$^2$) tensile strength and 200 Hv hardness, e.g., SUS 304 or SUS 316, ferritic stainless steel of about 2.5% IACS electrical conductivity at least 481 MPa (49 kgf/mm$^2$) tensile strength and 190 Hv hardness, e.g., SUS 405, SUS 429, SUS 430, SUS 430F or SUS 434, martensitic stainless steel of about 3.0% IACS electrical conductivity, at least 588 MPa (60 kgf/mm$^2$) tensile strength and 190 Hv hardness, e.g., SUS 403, SUS 410, SUS 416, SUS 420, SUS 431 or SUS 440C, a complex metal of 5 to 9% IACS electrical conductivity, at least 294 MPa (30 kgf/mm$^2$) tensile strength and 100 to 180 Hv hardness in which an iron, a nickel or cobalt, or an alloy as magnetic material including a plurality of holes of axial direction through a magnetically arc-rotating portion at an areal occupation ratio of 10 to 90%, are infiltrated with copper or silver, a complex metal of 2 to 30% IACS electrical conductivity consisting of 5 to 40% iron by weight, 5 to 40% chromium by weight, 1 to 10% molybdenum or tungsten by weight and a balance of copper, a complex metal of 3 to 30% IACS electrical conductivity consisting of 5 to 40% iron by weight, 5 to 40% chromium by weight, molybdenum and tungsten amounting in total to 1 to 10% by weight and either one amounting to 0.5% by weight, and a balance of copper, a complex metal of 3 to 25% IACS electrical conductivity consisting of a 29 to 70% austinitic stainless steel by weight, 1 to 10% molybdenum or tungsten by weight, and a balance of copper, a complex metal of 3 to 25% IACS electrical conductivity consisting of a 29 to 70% ferritic stainless steel by weight, 1 to 10% molybdenum or tungsten by weight, and a balance of copper, a complex metal of 3 to 30% IACS electrical conductivity consisting of a 29 to 70% martensitic stainless steel by weight, 1 to 10% molybdenum or tungsten by weight, and a balance of copper, a complex metal of 3 to 30% IACS electrical conductivity consisting of a 29 to 70% austinitic stainless steel by weight, molybdenum and tungsten amounting in total to 1 to 10% by weight and either one amounting to 0.5% by weight, and a balance of copper, a complex metal of 3 to 30% IACS electrical conductivity consisting of a 29 to 70% martensitic stainless steel by weight, molybdenum and tungsten amounting in total to 1 to 10% by weight and either one amounting to 0.5% by weight, and a balance of copper, and a complex metal of 3 to 25% IACS electrical conductivity consisting of a 29 to 70% ferritic stainless steel by weight, molybdenum and tungsten amounting in total to 1 to 10% by weight and either one amounting to 0.5% by weight, and a balance of copper.

The complex metal listed above are produced by substantially the same process as the first, second, third or fourth infiltration or sintering process.

What is claimed is:

1. A vacuum interrupter comprising a pair of separable electrodes (5, 6), each of which consists of a generally disc-shaped and magnetically arc-rotating portion (13) and a contact-making portion (14) projecting from an arcing surface of the magnetically arc-rotating portion (13), the magnetically arc-rotating portion (13) surrounding the contact-making portion (14), the conductivity of the contact-making portion (14) being different from that of the magnetically arc-rotating portion (13), a plurality of fingers (17) defined by a plurality of slots (16), each of which extends radially and circumferentially of the magnetically arc-rotating portion (13), and a vacuum envelope which is electrically insulating and enclosing the electrodes (5, 6) in a vacuum-tight manner, wherein said magnetically arc-rotating portion (13) of at least one (6) of the electrodes (5, 6) is made of a complex metal including 20 to 70% copper by weight and possessing a 2 to 30% IACS electrical conductivity and said contact-making portion (14) of said at least one electrode (6) is made of a complex metal including at least chromium and iron and possessing a 20 to 60% IACS electrical conductivity, the conductivity of the contact-making portion (14) of said at least one electrode (6) being higher than that of the magnetically arc-rotating portion (13) of said at least one electrode (6).

2. A vacuum interrupter as defined in claim 1, wherein said magnetically arc-rotating portion (13) of said at least one electrode (6) further includes 5 to 40% iron by weight and 5 to 40% chromium by weight.

3. A vacuum interrupter as defined in claim 1, wherein said magnetically arc-rotating portion (13) of said at least one electrode is further made of iron and chromium, and said contact-making portion (14) of said at least one electrode is further made of copper.

4. A vacuum interrupter as defined in claim 1, wherein said magnetically arc-rotating portion (13) of said at least one electrode (6) is further made of 5 to 40% iron by weight and 5 to 40% chromium by weight, and wherein said contact-making portion (14) of said at least one electrode (6) is further made of 20 to 70% copper by weight, 5 to 70% chromium by weight and 5 to 70% molybdenum by weight.

5. A vacuum interrupter as defined in claim 1, wherein said complex metal of said magnetically arc-rotating portion (13) of said at least one electrode (6) has a 10 to 15% IACS electrical conductivity.

6. A vacuum interrupter as defined in claim 1, wherein said complex metal of said contact-making portion (14) of said at least one electrode (6) is made of 20 to 70% copper by weight, 5 to 70% chromium by weight and 5 to 70% molybdenum by weight.

7. A vacuum interrupter as defined in claim 1, wherein said complex metal of said magnetically arc-rotating portion (13) of said at least one electrode (6) is made of 30 to 70% copper by weight and 30 to 70% by weight nonmagnetic stainless steel.

8. A vacuum interrupter as defined in claim 5, wherein said complex metal of said magnetically arc-rotating portion (13) of said at least one electrode (6) is made of 30 to 70% copper by weight and 30 to 70% nonmagnetic stainless steel.

9. A vacuum interrupter as defined in claim 1, wherein said complex metal of said magnetically arc-rotating portion (13) of said at least one electrode (6) is made of 30 to 70% copper by weight and a 30 to 70% magnetic stainless steel by weight.

10. A vacuum interrupter as defined in claim 1, wherein said complex metal of said magnetically arc-rotating portion (13) of said at least one electrode (6) is made of 30 to 70% copper by weight and 30 to 70% ferritic stainless steel by weight.

11. A vacuum interrupter as defined in claim 1, wherein said complex metal of said magnetically arc-rotating portion (13) of said at least one electrode (6) is made of 30 to 70% copper by weight and 30 to 70% martensitic stainless steel by weight.

12. A vacuum interrupter as defined in claim 9, wherein said complex metal of said contact-making portion (14) of said at least one electrode (6) is made of 20 to 70% copper by weight, 5 to 70% chromium by weight and 5 to 70% molybdenum by weight.

13. A vacuum interrupter as defined in claim 10, wherein said complex metal of said contact-making portion (14) of said at least one electrode (6) is made of 20 to 70% copper by weight and 5 to 70% chromium by weight and 5 to 70% molybdenum by weight.

14. A vacuum interrupter as defined in claim 11, wherein said complex metal of said contact-making portion (14) of said at least one electrode (6) is made of 20 to 70% copper by weight and 5 to 70% chromium by weight and 5 to 70% molybdenum by weight.

15. A vacuum interrupter as defined in claim 1, wherein said complex metal of said magnetically arc-rotating portion (13) of said at least one electrode (6) is made of a nonmagnetic stainless steel including a plurality of holes of axial direction through said magnetically arc-rotating portion (13) of said at least one electrode (6) at an areal occupation ratio of 10 to 90%, and infiltrant copper or silver into the nonmagnetic stainless steel, and wherein said complex metal of said contact-making portion (14) of said at least one electrode (6) is made of 20 to 70% copper by weight, 5 to 70% chromium by weight and 5 to 70% molybdenum by weight.

16. A vacuum interrupter as defined in claim 1, wherein said complex metal of said magnetically arc-rotating portion (13) of said at least one electrode (6) is made of a magnetic stainless steel including a plurality of holes of axial direction through said magnetically arc-rotating portion (13) of said at least one electrode (6) at an areal occupation ratio of 10 to 90%, and infiltrant copper or silver into the magnetic stainless steel, and wherein said complex metal of said contact-making portion (14) of said at least one electrode (6) is made of 20 to 70% copper by weight, 5 to 70% chromium by weight and 5 to 70% molybdenum by weight.

17. A vacuum interrupter as defined in claim 1, wherein said complex metal of said magnetically arc-rotating portion (13) of said at least one electrode (6) is further made of austinitic stainless steel of a 2 to 3% IACS electrical conductivity.

18. A vacuum interrupter as defined in claim 1, wherein said complex metal of said magnetically arc-rotating portion (13) of said at least one electrode (6) is further made of ferritic stainless steel of about a 2.5% IACS electrical conductivity.

19. A vacuum interrupter as defined in claim 1, wherein said complex metal of said magnetically arc-rotating portion (13) of said at least one electrode (6) is further made of martensitic stainless steel of about a 3.0% IACS electrical conductivity.

* * * * *